US006493905B2

(12) United States Patent
Stettler

(10) Patent No.: US 6,493,905 B2
(45) Date of Patent: Dec. 17, 2002

(54) HINGE SYSTEM FOR WATERCRAFT TRIM FLAP

(76) Inventor: Dana Stettler, 290 N. Smith St., Corona, CA (US) 92880

( * ) Notice: Subject to any disclaimer, the term of this patent is extended or adjusted under 35 U.S.C. 154(b) by 0 days.

(21) Appl. No.: 09/802,799

(22) Filed: Mar. 9, 2001

(65) Prior Publication Data

US 2002/0000023 A1 Jan. 3, 2002

Related U.S. Application Data

(60) Provisional application No. 60/188,642, filed on Mar. 10, 2000.

(51) Int. Cl.[7] ..... E05D 7/12
(52) U.S. Cl. ..... 16/271; 114/285; 16/273
(58) Field of Search ..... 16/385, 265, 271, 16/273; 403/381, 231, 68, 70; 114/285

(56) References Cited

U.S. PATENT DOCUMENTS 2,764,199 A * 9/1956 Tupper ..... 16/265
2,816,521 A 12/1957 Alexander
2,866,997 A * 1/1959 Eskridge et al. ..... 16/265
3,002,485 A 10/1961 Curtis
3,159,131 A 12/1964 Frederick
3,200,782 A 8/1965 Walden et al.
3,435,795 A 4/1969 Eckfield
3,610,460 A * 10/1971 Siklos et al. ..... 16/266
3,938,458 A 2/1976 Irgens
4,577,580 A 3/1986 Diffely, Sr.
5,075,927 A * 12/1991 Porta ..... 16/273

* cited by examiner

*Primary Examiner*—Anthony Knight
*Assistant Examiner*—Michael W. White
(74) *Attorney, Agent, or Firm*—Arter & Hadden LLP

(57) ABSTRACT

A hinge is disclosed comprising a mounting member for mounting to a stationary operational surface and having a hinge portion formed along the longitudinal extent of the mounting member. An elongate shaft is included having a hollow cross-sectional profile and formed along the longitudinal extent of the hinge portion. An elongate mouth is formed at the opening of the shaft and has a cross-sectional profile of smaller extent than the cross-sectional profile of the elongate shaft. A flap attachment member including an elongate hinge member is disclosed having a cross-sectional shape that conforms to the cross-sectional profile of the elongate shaft, and being received in the shaft and retained by the elongate mouth to thereby rotatably couple the flap attachment member to the mounting member.

11 Claims, 4 Drawing Sheets

HINGE SYSTEM FOR WATERCRAFT TRIM FLAP

RELATED APPLICATIONS

The present application claims the benefit of U.S. Provisional Application No. 60/188,642, filed Mar. 10, 2000.

NOTICE OF COPYRIGHTS AND TRADE DRESS

A portion of the disclosure of this patent document may contain material that is subject to copyright protection. This patent document may show and/or describe matter that is or may become trade dress of the owner. The copyright and trade dress owner has no objection to the facsimile reproduction by anyone of the disclosure, as it appears on the Patent and Trademark Office patent files or records, but otherwise reserves all copyright and trade dress rights whatsoever.

BACKGROUND OF THE INVENTION

The present invention is directed to the field of hinges, particularly of the type used for watercraft trim flaps. Such trim flaps are used to change the attitude of a watercraft, to control the amount by which the bow of the watercraft comes up and down out of the water, particularly during acceleration procedures. Previous type trim flap hinges are made in a manner typical of other types of hinges, i.e. distinct male and female members are fashioned and cross-drilled, after which a bolt is inserted to hold the members together. This process is very labor-intensive, resulting in a finished product that is difficult and time-consuming to manufacture, and consequently expensive.

SUMMARY OF THE INVENTION

In view of the difficulties and drawbacks associated with the previous devices, there is therefore a need for a hinge that is quickly and easily manufactured.

There is also a need for a hinge that can be manufactured with reduced expense and improved efficiency.

There is also a need for a trim flap hinge having improved performance.

These needs and others are satisfied by the hinge of the present invention as disclosed herein comprising a mounting member for mounting to a stationary operational surface and having a hinge portion formed along the longitudinal extent of the mounting member. An elongate shaft is included having a hollow cross-sectional profile and formed along the longitudinal extent of the hinge portion. An elongate mouth is formed at the opening of the shaft and has a cross-sectional profile of smaller extent than the cross-sectional profile of the elongate shaft. A flap attachment member including an elongate hinge member is disclosed having a cross-sectional shape that conforms to the cross-sectional profile of the elongate shaft, and being received in the shaft and retained by the elongate mouth to thereby rotatably couple the flap attachment member to the mounting member.

As will be realized, the invention is capable of other and different embodiments and its several details are capable of modifications in various respects, all without departing from the invention. Accordingly, the drawing and description are to be regarded as illustrative and not restrictive.

DETAILED DESCRIPTION OF THE INVENTION

Figure 1:
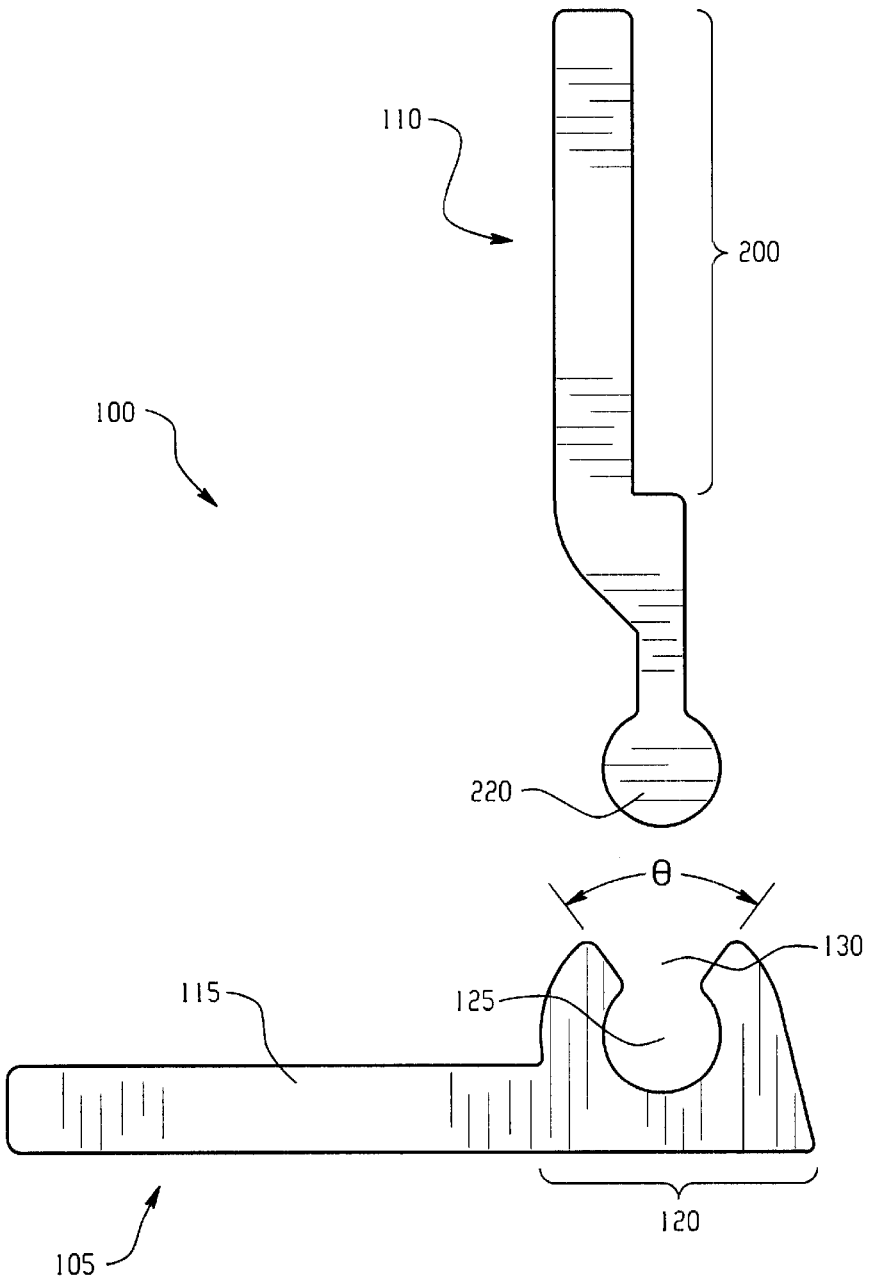
FIG. 1 is an exploded side view of a hinge system in accordance with the present invention.
Figure 2:
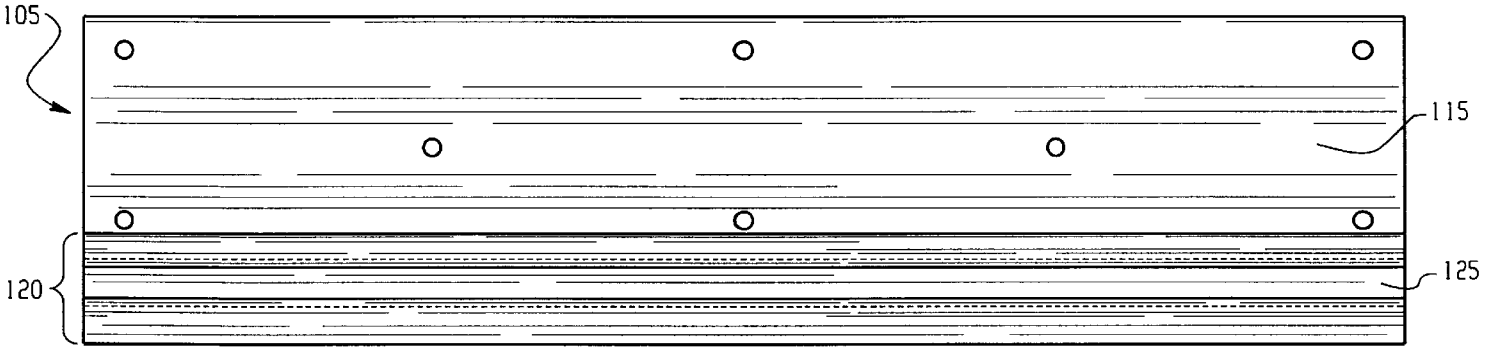
FIG. 2 is a top view of a mounting member in accordance with the present hinge system.
Figure 3:
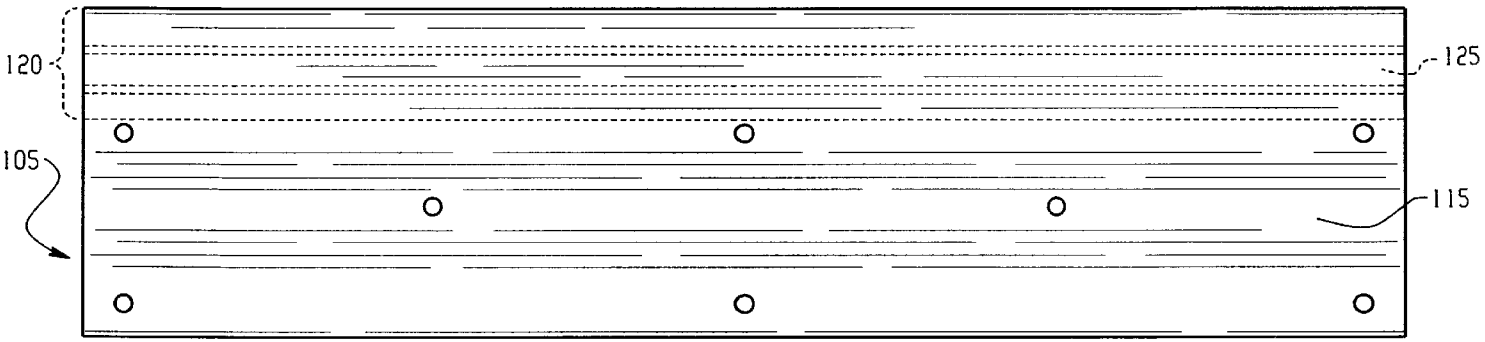
FIG. 3 is a bottom view of a mounting member in accordance with the present hinge system.
Figure 4:
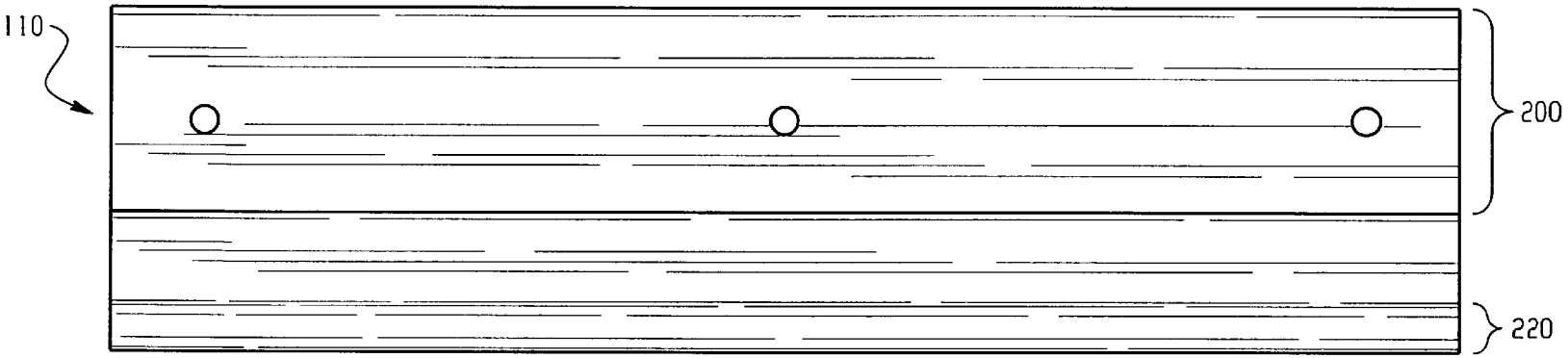
FIG. 4 is a top view of a flap attachment member in accordance with the present hinge system.
Figure 5:
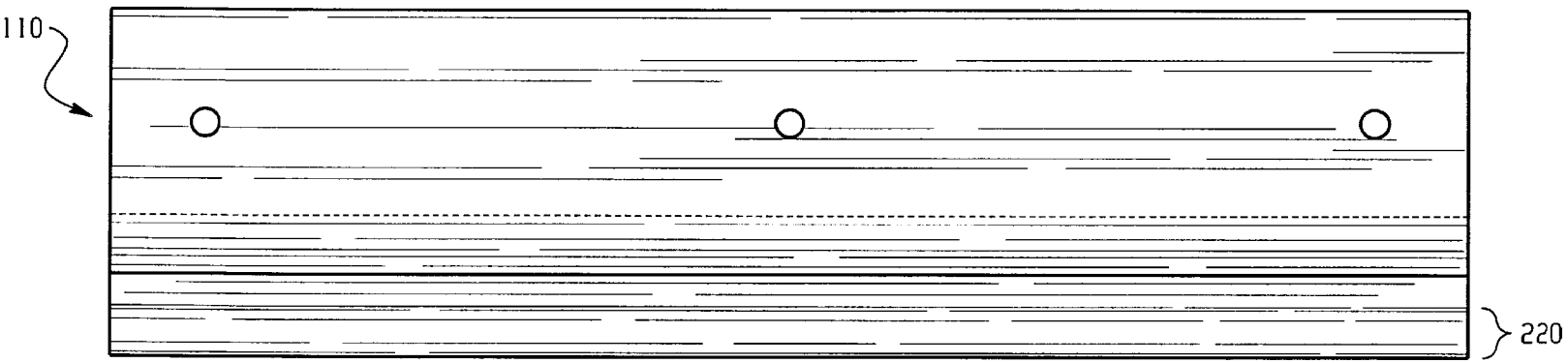
FIG. 5 is a bottom view of a flap attachment member in accordance with the present hinge system.

With reference to FIG. 1, there is shown an exploded side view of the trim flap hinge system 100 comprised of a mounting member 105 and a flap attachment member 110 that rotatably couples to the mounting member 105. FIGS. 2 and 3 show top and bottom views, respectively, of the mounting member 105. FIGS. 4 and 5 show top and bottom views, respectively, of the flap attachment member 110.

With reference to FIGS. 1–3, the mounting member 105 includes a plate portion 115 that can be mounted onto a watercraft using mounting holes that are distributed throughout the plate portion 115. The mounting member 105 further includes a hinge portion 120 that extends lengthwise along the mounting member 105. An elongate shaft 125 having a substantially circular cross-section extends along the length of the hinge portion 120. An elongate mouth 130 is provided having a cross-section of smaller extent than the cross-section of the hinge portion 120. The elongate mouth 130 opens into the shaft 125 along the entire length of the shaft 125.

Figure 6:
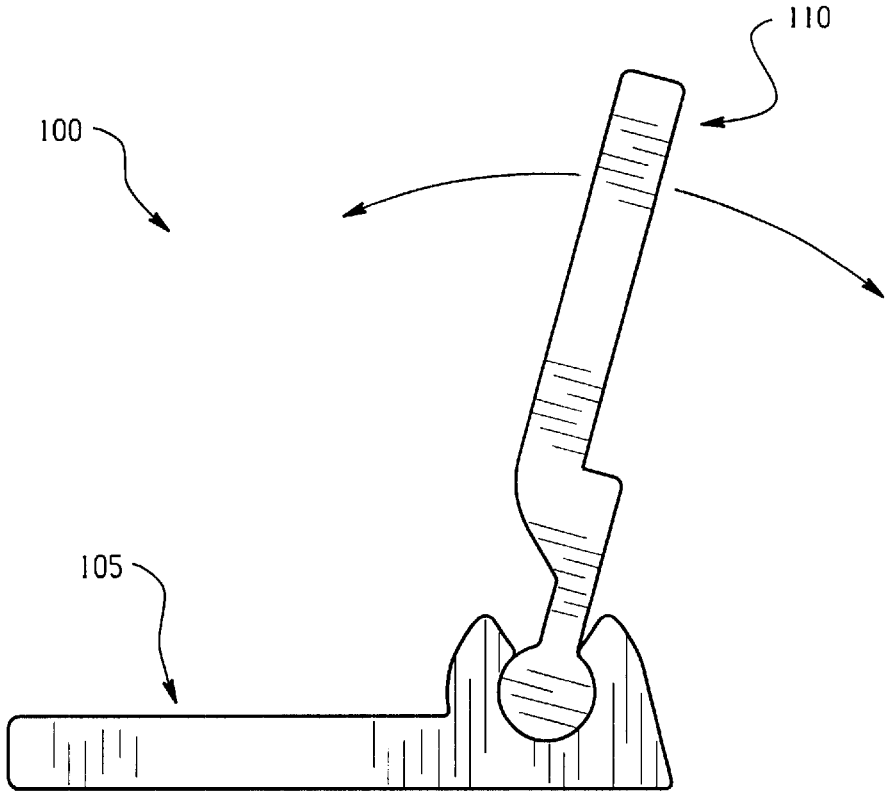
FIG. 6 is a side view of the flap attachment member coupled to the mounting member in accordance with the present hinge system.

With reference now to FIGS. 1, 4, and 5, the flap attachment member 110 includes a flap mounting portion 200 that defines a slot sized to receive a trim flap for a watercraft, The flap attachment member 110 also includes a hinge portion comprised of an elongate hinge member 220 having a cross-sectional shape that conforms to the cross-sectional shape of the shaft 125. The hinge member 220 is thus slidable into the shaft 125 to thereby rotatably couple the flap attachment member 110 to the mounting member 105, as shown in the side view of FIG. 6. The circular cross-sectional shape of the shaft 125 and hinge member 220 allow the hinge member 220 to rotate within the shaft about an axis of rotation that is axially aligned with the axis of the shaft 125.

The hinge member 110 rotates about an angle θ (FIG. 1) when the hinge member 110 is coupled to the attachment member 105. The range of rotation is limited by the size of the mouth 130. A trim flap may be attached to the attachment member 110 and the hinge system 110 may then be mounted onto a watercraft. The rotatable coupling between the mounting member 105 and the flap attachment member 110 allows the trim flap to be rotated to various trim positions. The trim flap can be displaced using a hydraulic cylinder or other common type means such as is known in the art.

The hinge system 100 is preferable manufactured of a material that is sufficiently strong to withstand the forces that are incurred by a trim flap of a watercraft. In the preferred embodiment, the mounting member 105 and the attachment member 110 are both manufactured of aluminum. The particular shape of the members may be formed using an extrusion process ion a mill or may be cast per print. By manufacturing a trim flap hinge in the manner of the present invention as disclosed above, manufacturing time can be reduced by 75% to 90% of the time used in manufacturing previous-type hinges. In this manner, a considerable savings can be realized, thereby greatly improving efficiency and ease of manufacture.

As a special feature of the invention, the hinge member 220 can be coated with material that greatly reduces frictional contact, preferably a polymer material e.g. a fluorinated polymer such as the type sold under the trade name TEFLON® or a similar product. This material can be applied using a "shrink-wrap" technique or other common method of application, prior to assembly of the components. Further, the interior surface of the shaft 125 can be coated with such a material, either alternatively to or in conjunction with coating the hinge member. In this way, metal-to-metal contact is greatly reduced between the hinge member 220 and the shaft 125, thus significantly improving performance and extending the operational life of the hinge product.

As described hereinabove, the present invention therefore solves many problems associated with previous type methods and implementations. However, it will be appreciated that various changes in the details, materials and arrangements of parts which have been herein described and illustrated in order to explain the nature of the invention may be made by those skilled in the are within the principle and scope of the invention will be expressed in the appended claims.

I claim:

1. A watercraft trim flap assembly comprising:

a trim flap for a watercraft;

a mounting member for mounting to a watercraft and having a hinge portion formed along the longitudinal extent of the mounting member;

an elongate shaft having a hollow cross-sectional profile and formed along the longitudinal extent of the hinge portion;

an elongate mouth formed at the opening of the shaft and having a cross-sectional profile of smaller extent than the cross-sectional profile of the elongate shaft;

a flap attachment member including an elongate hinge member having a cross-sectional shape that conforms to the cross-sectional profile of the elongate shaft, and being received in the shaft and retained by the elongate mouth to thereby rotatably couple the flap attachment member to the mounting member, wherein the flap attachment member includes a flap mounting portion sized to receive the trim flap.

2. The watercraft trim flap assembly of claim 1 wherein the hinge member is slidably inserted into the shaft to be retained therewith.

3. The watercraft trim flap assembly of claim 1 wherein the elongate shaft has a substantially circular cross-sectional profile.

4. The watercraft trim flap assembly of claim 3 wherein the hinge member has a substantially circular cross-sectional profile to allow the hinge member to rotate within the shaft about an axis of rotation that is axially aligned with the axis of the shaft.

5. The watercraft trim flap assembly of claim 4 wherein the hinge member rotates about an angle $\theta$ wherein the range of rotation is limited by the size of the elongate mouth.

6. The watercraft trim flap assembly of claim 1 wherein the elongate mouth opens into the shaft along the entire length of the shaft.

7. The watercraft trim flap assembly of claim 1 wherein the mounting member and the flap attachment member are formed of aluminum.

8. The watercraft trim flap assembly of claim 1 wherein the mounting member and the flap attachment member are each formed having an extrusion profile.

9. The watercraft trim flap assembly of claim 1 wherein at least one of the hinge member and the elongate shaft are coated with a polymer material that greatly reduces frictional contact.

10. The watercraft trim flap assembly of claim 9 wherein the polymer material is TEFLON®.

11. The watercraft trim flap assembly of claim 1 wherein the mounting member includes a plate portion for mounting onto the watercraft, further comprising mounting holes that are distributed along the longitudinal extent of the plate portion.

* * * * *